US006527604B2

(12) United States Patent
Tsubouchi et al.

(10) Patent No.: US 6,527,604 B2
(45) Date of Patent: Mar. 4, 2003

(54) OUTBOARD ENGINE WITH IMPROVED OIL RETURN PATH

(75) Inventors: Masanori Tsubouchi, Wako (JP); Tatsuya Kuroda, Wako (JP); Haruo Tsusaka, Wako (JP); Masaki Tsunoda, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/075,085

(22) Filed: Feb. 13, 2002

(65) Prior Publication Data

US 2002/0111091 A1 Aug. 15, 2002

(30) Foreign Application Priority Data

Feb. 14, 2001 (JP) ..... 2001-037602

(51) Int. Cl.[7] ..... B63H 21/10
(52) U.S. Cl. ..... 440/88
(58) Field of Search ..... 440/88, 76, 900; 123/195 P

(56) References Cited

U.S. PATENT DOCUMENTS 5,687,688 A * 11/1997 Tsunoda et al. ..... 123/196 W
5,803,036 A * 9/1998 Takahashi et al. ..... 123/179.25
5,876,188 A * 3/1999 Okamoto ..... 417/364

FOREIGN PATENT DOCUMENTS

JP 07-149290 6/1995

* cited by examiner

*Primary Examiner*—Ed Swinehart
(74) *Attorney, Agent, or Firm*—Carrier, Blackman & Associates, P.C.; Joseph P. Carrier; William D. Blackman

(57) ABSTRACT

A compact and lightweight outboard engine (1) mounted to a boat stern by a mounting device having a tilt shaft comprises: an engine (2) including a flywheel (56) positioned at a lower end portion of a vertically extending crankshaft, and an oil pan positioned below the flywheel (56). An upper wall of a flywheel chamber (59) accommodating the flywheel 56 is made up of a bottom wall of a crank chamber made of a crankcase (30), etc., and a bottom wall (30*a*) of the crankcase (30) forming a front portion of the engine body (3) has a return oil path 71 formed forward of an inner circumferential wall surface (60*e*) of a circumferential wall (60) of the flywheel chamber (59) and having inflow openings (71*a*, 71*b*) through which lubricant oil flows from the crank chamber. Such outboard engine prevents output loss by preventing or minimizing lubricant oil staying in the crank chamber while the engine is driven in a tilt-up condition.

11 Claims, 11 Drawing Sheets

(A)

(B)

OUTBOARD ENGINE WITH IMPROVED OIL RETURN PATH

BACKGROUND OF THE INVENTION

1. Field of the Invention

This invention relates to an outboard engine mounted to a boat's stern with a mounting device having a tilt shaft, and more particularly, to a structure related to a return oil path for returning lubricant oil to an oil pan after lubricating portions of an engine to be lubricated.

2. Description of the Related Art

Heretofore, lubricant oil discharged from an oil pan in an outboard engine has been returned to the oil pan located at a lower portion of an engine body through a return oil path after lubricating some portions of the engine to be lubricated. Regarding such a return oil path, in an outboard engine disclosed in Japanese Patent Laid-Open Publication No. hei 7-149290, for example, an opening is provided in an occlusive plate forming the bottom wall of the engine block of the engine having a vertically extending crankshaft, such that return oil flowing from the crank chamber onto the occlusive plate can drop into the oil pan through the opening through an oil communication path formed in an engine mount case. Below the occlusive plate, a flywheel is disposed, which is fixed to a lower end portion of the crankshaft extending through the occlusive plate, covered by the occlusive plate thereabove, and surrounded by the circumferential wall of an engine mount case and an encircling wall. The oil communication path is formed between the encircling wall that is one of the circumferential wall and the encircling wall located behind and another circumferential wall located behind the encircling wall with a distance, and the opening is formed at a rear portion of the occlusive plate opposite from the flywheel located forward with respect to the encircling wall.

In the conventional outboard engine, the opening defining the return oil path for returning the lubricant oil accumulating in the crank chamber to the oil pan is located at a rear portion of the crank chamber located above the flywheel. Therefore, if the outboard engine is driven in a tilt-up condition during cruising in shallow water, part of the lubricant oil on the occlusive plate stays in a front portion within the crank chamber. As a result, the quantity of the lubricant oil returning to the oil pan decreases as much as the retained quantity. Thus, in order to prevent shortage of the supply amount of lubricant oil to portions to be lubricated, the conventional outboard engine has the need of using a large quantity of lubricant oil beforehand, and this forces to use a bulky oil pan and hence causes the outboard engine to be bulky and heavy. Furthermore, in a configuration where the crankshaft stirs the lubricant oil staying in the crank chamber, it invites an increase of the output loss of the engine. In addition, since a relatively large quantity of retained lubricant oil rushes to the opening immediately after the tilt-up is released during operation of the outboard engine, for the purpose of ensuring smooth outflow of lubricant oil from the crank chamber, the opening must be large, the occlusive plate inevitably becomes large, and these have encumbered realization of a compact, lightweight outboard engine.

The present invention has been made cognizing those problems in the background, and its main object is to provide a compact, lightweight outboard engine and prevent its output loss by substantially eliminating or minimizing the possibility of lubricant oil staying in the crank chamber during operation of the outboard engine in the tilt-up condition. Another object of the invention is to enable an inflow opening of the return oil path to be located in an optimum location.

SUMMARY OF THE INVENTION

According to the invention, there is provided an outboard engine having an engine body, an engine including a flywheel positioned at a lower end portion of a crankshaft extending vertically in the engine body and an oil pan positioned below the flywheel, a supply oil path for supplying lubricant oil released from an oil pump to a portion of the engine to be lubricated, and a return oil path for returning lubricant oil supplied to the portion to be lubricated back to the oil pan, and mounted to a boat stern with a mount device having a tilt shaft, characterized in that an upper wall of a flywheel chamber accommodating the flywheel is made up of a bottom wall of a crank chamber of the engine, the bottom wall having a front return oil path at a location forward of an inner circumferential surface of a circumferential wall of the flywheel chamber, the front return oil path being an oil path forming the return oil path to return lubricant oil from the crank chamber.

According to the invention, lubricant oil present in the crank chamber after lubricating portions of the engine to be lubricated flows down or drops onto the bottom wall of the crank chamber, then flows along the upper surface of the bottom wall forming the upper wall of the flywheel chamber, and flows into the return oil path, exiting from the crank chamber, until finally returning back to the oil pan 5. When the outboard engine is driven under a tilt-up condition, such as during cruising in shallow water, lubricant oil flowing on the bottom wall, then inclining down forward, flows into the front return oil path positioned forward of the inner circumferential wall surface of the circumferential wall of the flywheel chamber. Therefore, during operation under a tilt-up condition, it is possible to substantially prevent or minimize lubricant oil staying on the bottom wall. Also, immediately after the tilt-up condition is released, since substantially no lubricant oil or only an extremely small amount of lubricant oil stays in the cranks chamber, lubricant oil smoothly flows out from the crank chamber through the front return oil path.

As a result, the following effects are obtained. That is, when the outboard engine is in a tilt-up condition, since almost all of lubricant oil present on the bottom wall of the crankcase in the crank chamber flows into the front return oil path and finally returns back to the oil pan without staying on the bottom wall, it is possible to substantially prevent or minimize lubricant oil staying on the bottom wall. Therefore, unlike the conventional techniques, there is no need of increasing the quantity of lubricant oil retained in the oil pan, which will be required to be larger in capacity, taking account of the quantity of lubricant oil that will stay in the crank chamber. Accordingly, the oil pan can be decreased in size and weight, and the outboard engine can be decreased in size and weight as well.

Further, since it is substantially prevented that the crankshaft stirs lubricant oil staying in the crank chamber, output loss by agitation of lubricant oil can be prevented. Furthermore, since substantially no or only an extremely small amount of lubricant oil stays in the crank chamber, the front return oil path need not be increased in diameter for the purpose of ensuring smooth outflow of lubricant oil from the crank chamber including the lubricant oil having stayed there, immediately after the tilt-up condition is canceled, the front return oil path can be decreased in diameter in comparison to those of the conventional techniques, and the outboard engine can be made compact and lightweight so much.

Preferably, the circumferential wall is made up of double-wall portions and single-wall portions, a left wall portion and a right wall portion of the circumferential wall are made up of the single-wall portions, a front wall portion of the circumferential wall is made up of the double-wall portion having an inner wall and an outer wall, and the inner wall and the outer wall of the front wall portion define a space therebetween, in which the return oil path is formed.

According to this configuration, since the left wall portion and the right wall portion forming a part of the circumferential wall of the flywheel chamber are made up of single-wall portions, i.e. single-layered walls in the radial direction of the flywheel, the outer diameter of the flywheel chamber decreases in the right and left direction, and the front return oil path is formed in a space defined between the inner wall and he outer wall of the front wall portion. Thus the front return oil path can be made, making use of the circumferential wall of the flywheel chamber.

As a result, the following effects are obtained. That is, since the left wall portion and the right wall portion of the circumferential wall of the flywheel chamber are made up of single wall portions, the outer diameter of the flywheel chamber decreases in the right and left direction, and accordingly, the outboard engine decreases in width in the right and left direction, thereby contributing to making the outboard engine compact and increasing the freedom of location thereof on the boat stern. Furthermore, since the front return oil path is made by making use of the space between the inner wall and the outer wall of the front wall portion of the flywheel chamber, it is prevented that the bottom wall of the crank chamber becomes excessively large in the front and rear direction to make the front return oil path, and the outboard engine can be reduced in size and weight.

Preferably, the engine body in the outboard engine includes a cylinder block and a crankcase united to a front portion of the cylinder block to define the crank chamber, the bottom wall having formed the front return oil path being the bottom wall of the crankcase, an inner wall surface rising from an upper surface of the bottom wall of the crankcase cooperating with the upper surface of the bottom wall to define a projection space projecting forward in its plane view, and an inflow opening of the front return oil path opening in proximity of a rising start portion at a front-most portion of the projection space.

In this manner, because the inflow opening of the front return oil path made in the crankcase forming a front portion of the engine body opens in proximity of a rising start portion of the front-most portion of the projection space defined by the crankcase positioned in front of the engine body, when the outboard engine is driven under a tilt-up condition, lubricant oil flowing on the bottom wall then inclining down forward flows toward the front-most portion that is positioned in the lowest level, and flows into the inflow opening formed in proximity of the rising start portion of the front-most portion. As a result, a quantity of lubricant oil staying in the crank chamber is further reduced, and the effect of reducing the size and weight of the outboard engine and preventing the output loss is further enhanced.

The crankcase may have a front supply oil path formed to pass through the bottom wall to serve as an oil path forming the supply oil path, and the inflow opening may be located nearer to a reference plane including a rotation axis of the crankshaft and perpendicular to the center axis of the tilt shaft than the front supply oil path in the bottom wall of the crankcase.

In this manner, in the bottom wall of the crankcase, since the inflow opening is provided at a location nearer to the reference plane including the rotation axis of the crankshaft and perpendicular to the center line of the tilt shaft than the front supply oil path, without any restriction from the front supply oil path made in the bottom wall of the crankcase, the inflow opening is positioned at a location near to the reference plane where lubricant oil is likely to gather from peripheral portions distant from the referenced plane.

As a result, the following effects are obtained. That is, it is possible to select the best location for the inflow opening on the upper surface of the bottom wall of the crankcase, where lubricant oil is likely to flow in. That is, the inflow opening can be formed at an optimum location.

The outer circumferential wall of a pump body of the oil pump may makeup the circumferential wall throughout the entire circumference thereof, the engine body being united to a support portion formed as a part of a mount case via the outer circumferential wall at a coupling portion formed as a part of the engine body, and the coupling portion, the outer circumferential wall and the support portion being substantially equal in outer diameter.

In this manner, the structure substantially equalizing the outer diameter of the connecting portion from the support portion of the mount case, outer circumferential wall of the pump body of the oil pump to the coupling portion of the engine body to the outer diameter of the circumferential wall of the flywheel chamber produces the following effects. That is, in the outboard engine in which the engine body is united to the mount case through the pump body, since the outer diameter of the connecting portion from the support portion of the mount case to the coupling potion of the engine body can be minimized within a range sufficient for the pump body to accommodate the flywheel, the outboard engine can be further reduced in size and weight.

DESCRIPTION OF THE PREFERRED EMBODIMENTS

Embodiments of the invention will now be explained below with reference to FIGS. 1 through 11. In the following explanation, directions or portions such as front, rear, left, right, etc. are used with respect to those of the boat's stern on which the outboard engine is borne.

Figure 1:
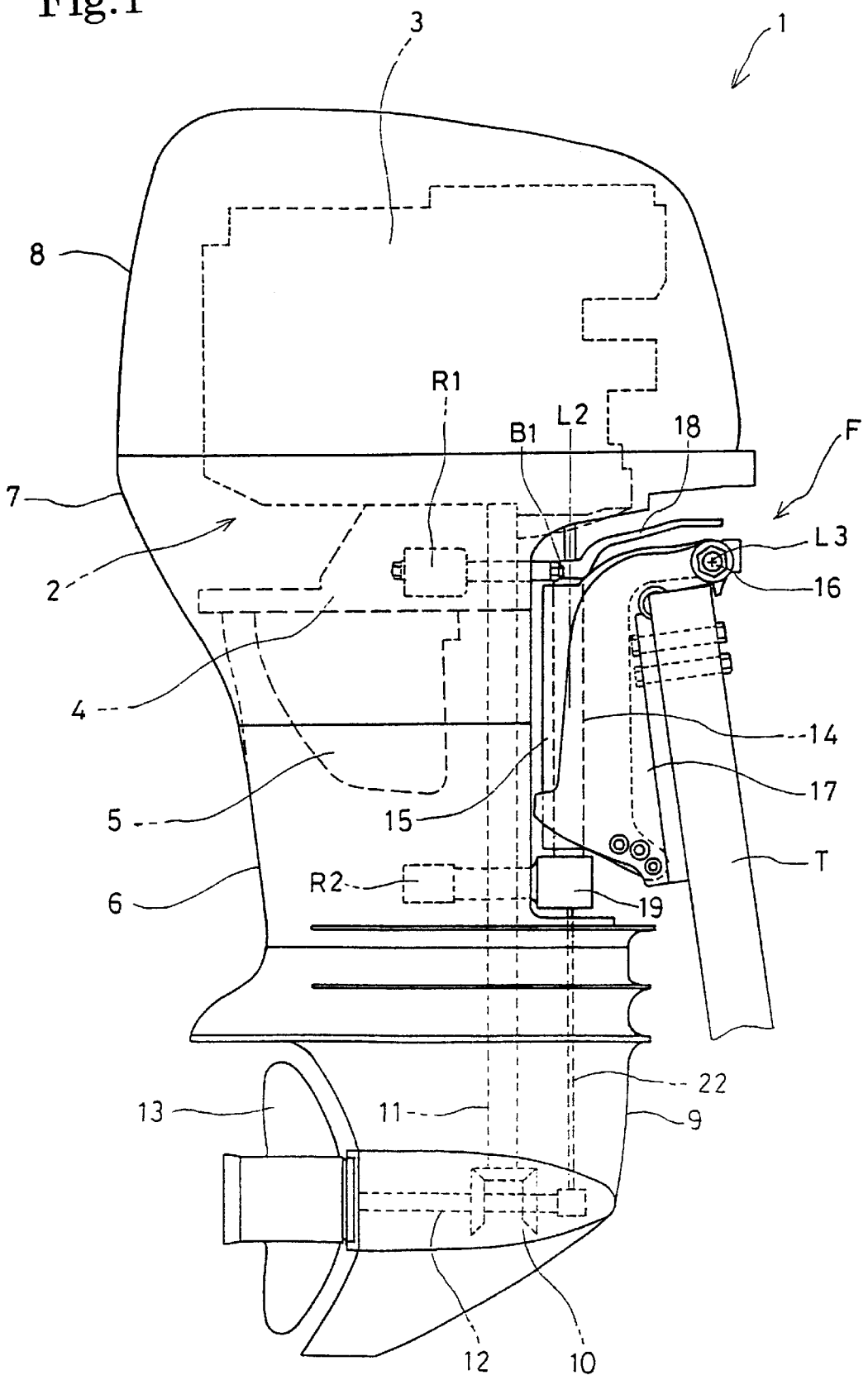
FIG. 1 is a schematic right side elevational view of an outboard engine according to an embodiment of the invention.
Figure 2:
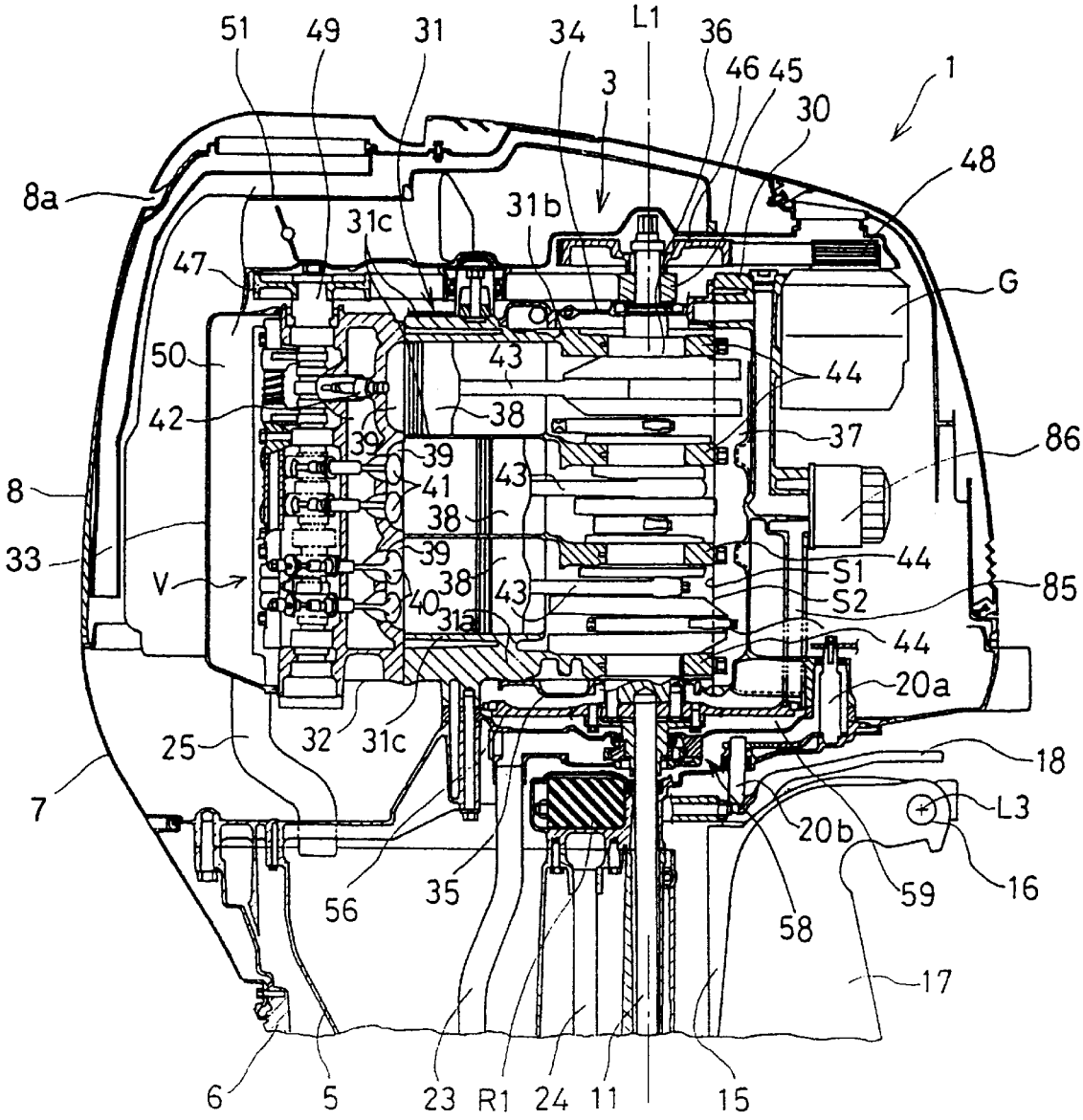
FIG. 2 is a fragmentary cross-sectional view of the outboard engine of FIG. 1, taken along a vertical plane approximately including the rotating axis of the crankshaft and the center axis of the left bank cylinder.

Referring to FIG. 1, which is a schematic right side elevational view of the outboard engine 1 according to an embodiment of the invention, the outboard engine 1 includes an engine 2 having a crankshaft 36 extending vertically (see FIG. 2). The engine body 3 of the engine 2 is supported on a mount case 4. United to a lower end portion of the mount case 4 are an oil pan 5 and an extension case 6 covering members extending downward from the engine body 3 including the oil pan 5. United to an upper end portion of the extension case 6 is an under cover 7 to define an engine room for accommodating the engine body 3. To a lower end portion of the extension case 6, a gear case 9 is united, which accommodates a headway/sternway switching device 10.

A drive shaft 11 coupled to the crankshaft 36 for integral rotation therewith extends downward through the extension case 6 into the gear case 9, and a lower end portion of the drive shaft 11 is coupled to a propeller shaft 12 having propellers 36 via the headway/sternway switching device 10. Therefore, driving power of the engine 2 is transmitted to the propellers 13 through the crankshaft 36, drive shaft 11, headway/sternway switching device 10 and propeller shaft 12, and rotates the propeller 13.

Figure 3:
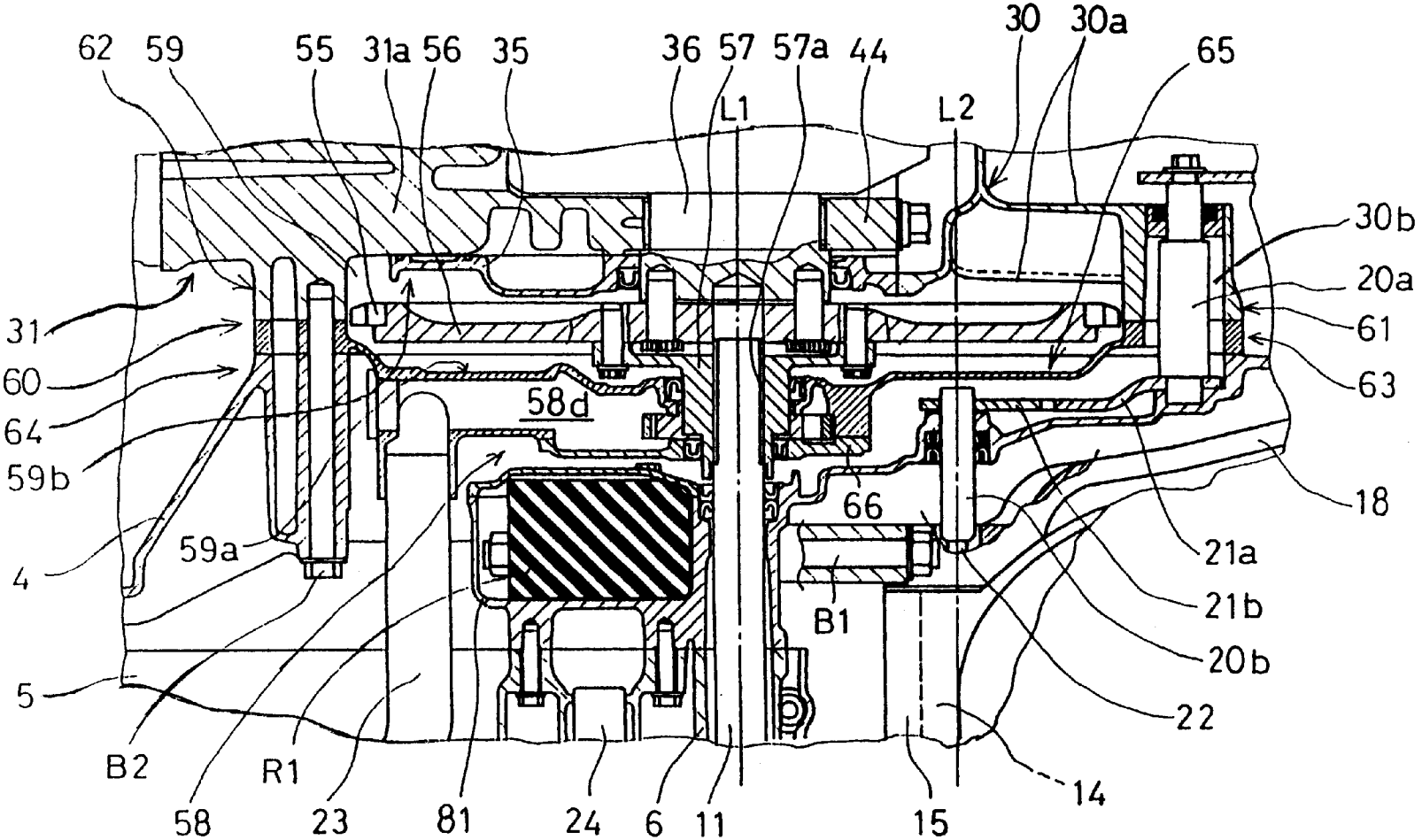
FIG. 3 is a fragmentary enlarged view of FIG. 2.

Referring to FIGS. 1–3 in combination, the outboard engine 1 is mounted to the boat's stern by a mounting device F. The mounting device F includes a swivel shaft 14, swivel case 15 pivotably supporting the swivel shaft 14, tilt shaft 16 pivotably supporting the swivel case 15, and stern bracket 17 affixed with the tilt shaft 16 at an upper end portion and fixed to the read end of the stern T. The swivel shaft 14 is formed integrally with amount frame 18, and it is secured, at its upper end portion, to the mount case 4 through mount rubber R1 with a pair of stud bolts B1 fixed to the mount frame 18. Additionally, the swivel shaft 14 is fixed secured to the extension case 6 through mount rubber R2 with a pair of stud bolts (not shown) fixed to a housing 19 in spline coupling with a lower portion of the swivel shaft 14.

The mounting device F permits the outboard engine 1 to swing right end left about the pivotal axis, which is the center axis 12 of the swivel shaft 14, and to swing up and down about the pivotal axis, which is the horizontal center axis L3 of the tilt shaft 16. As to operation of a shift manipulator for switching forward and backward movement of the boat stern T, as shown in FIGS. 2 and 3, a shift rod 22 passing inside the cylindrical swivel shaft 14 is rotated through a pair of shifting shafts 20*a,* 20*b* interlinked via a pair of segment gears 21*a,* 21*b* in engagement with each other, and based on the rotation of the shift rod 22, the headway/sternway switching device 10 changes headway and sternway movements of boat stern T.

Figure 4:
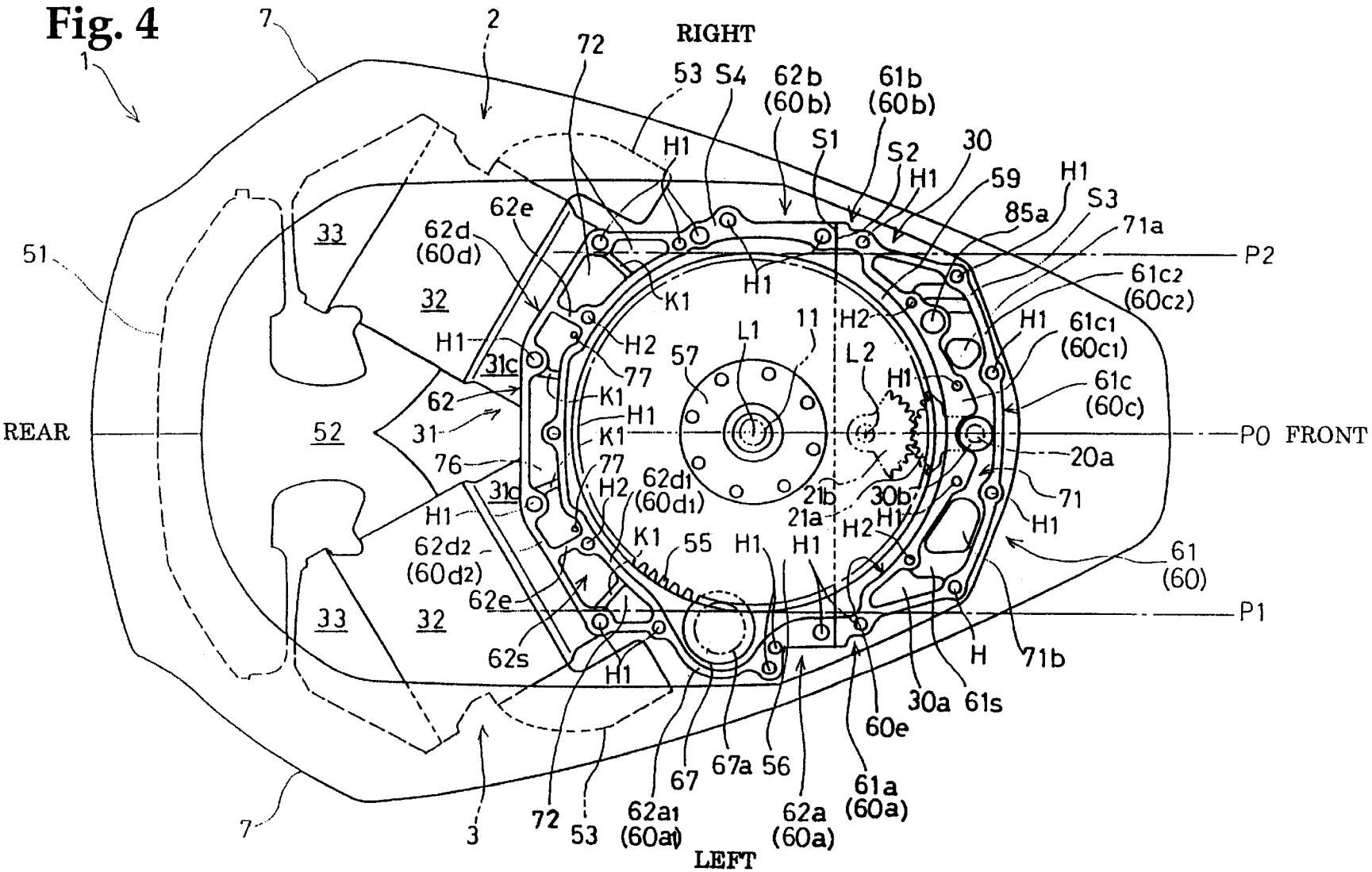
FIG. 4 is a bottom view of a crankcase and a cylinder block of an engine of the outboard engine of FIG. 1.

Referring to FIGS. 2 and 4, further explanation is made about the engine. The engine 2 is a V-type six-cylinder water-cooled SOHC four-stroke cycle internal combustion engine, and its engine body 3 is made up of a crankcase 30, which forms the front portion of the engine body 3, cylinder block 31, cylinder heads 32 of respective banks, head cover 33, upper seal cover 34, and lower seal cover 35. These crankcase 30, cylinder block 31, cylinder head 32 and head cover 33 are assembled in this order from headway to sternway of the boat stern T.

A pair of banks of the cylinder block 31 has a V configuration opening backward when viewed in a plan view (see FIG. 4). Each bank is made up of three cylinders 31*c* aligned vertically along the crankshaft 36. The cylinder block 31 is a so-called deep skirt type cylinder block in which right and left wall portions constitute skirt portions extending forward beyond the rotation axis L1 of the crankshaft 36 and a fitting surface S2 for close contact with a fitting surface S1 of the crankcase 30 is positioned forward of the rotation axis L1. Therefore, the upper seal cover 34 and the lower seal cover 35 having holes permitting the crankshaft 36 to liquid-tightly pass through are joined to the upper wall 31*b* and the lower wall 31*a* of the cylinder blocks 31 by applying bolts to the cylinder block 31 and the crankcase 30 to cooperate with the front portion of the cylinder block 31, skirt portion and crankcase 30 to define a crank chamber 37, and the fitting surfaces of both seal covers 34, 35 with the crankcase 30 lie on the common plane to that of the fitting surface S2. Then the bottom wall of the crank chamber 37 is made up of the lower seal cover 35 and the bottom wall of the crankcase 30.

In association of the cylinder head 32 of each bank, there are provided a pair of intake valves 40 for opening or closing a pair of intake openings, which open into a combustion chamber 39 defined between the cylinder head 32, and a piston 38 slidably fitting in each cylinder 31*c,* and a pair of exhaust valves 41 for opening or closing a pair of exhaust openings, which open into the combustion chamber 39. A sparkplug is also attached to the cylinder head 32 to orient the center of the combustion chamber 39. The piston 38 is connected to the crankshaft 36 via a connection rod 43, and the crankshaft 36 is driven for rotation movements by the reciprocating piston 38. Four journals of the crankshaft 36 are supported individually by the cylinder block 31 and a bearing cap 44 attached to the cylinder block 31, via a plane bearing. In this manner, the crankshaft 36 can rotate relative to the cylinder block 31.

To the top end of the crankshaft 36 projecting upward from the upper seal cover 34, a first drive pulley 45 is coupled, and a second drive pulley 46 thereon. A timing belt is provided to wrap the first drive pulley 45 and a first idler pulley 47 coupled to an upper end portion of a cam shaft 49 rotatably supported by the cylinder head 32 of each bank to extend vertically, such that the cam shafts 49 of both banks are driven to rotate at a half revolution of the crankshaft 36. Thus the valve drive mechanism V made up of the cam shaft 49, intake and exhaust cams formed on the cam shaft 49, intake rocker arm and exhaust rocker arm contacting with and swung by the those cams to open or close an intake valve 40 or exhaust valve 41, respectively, is disposed in a valve drive chamber 50 defined by the cylinder head 32 and the head cover 33. On the other hand, a drive belt is provided to wrap the second drive pulley 46 and a second idler pulley 48 coupled to an upper end portion of the rotating shaft of an alternating current generator G, and the rotating shaft is driven to rotate by the crankshaft 36.

At the other end of each intake port having formed a pair of intake openings at one end, the downstream end of an intake manifold 52 (see FIG. 4) having formed a fuel injection valve is connected, and air for combustion is supplied to the combustion chamber 39 together with a fuel injected from the fuel injection valve through the intake device made up of an intake duct 51 having a throttle valve connected to an air intake opening 8a of the engine cover 8 and the intake manifold 52 and through an intake port. On the other hand, at the other end of each exhaust port having a pair of exhaust openings at one end, the upstream end of the exhaust manifold 53 is connected, and combustion gas from each combustion chamber 39 is discharged from the exhaust opening into water through an exhaust port, an exhaust device made up of an exhaust manifold 53 and exhaust tube 54 (see FIG. 8), and through the extension case 6 and the gear case 9.

On the other hand, as best shown in FIG. 3 that is an enlarged view of a lower end portion of the engine body 3, at the bottom end of the crankshaft 36 projecting downward from the lower seal cover 35, a flywheel 56 having formed a ring gear along the circumference thereof is united with bolts. To the bottom surface of the flywheel 56, a cylindrical spline piece 57 is coupled, and the upper end of the drive shaft 11 is in spline coupling with the spline piece 57 in its inner hole 57*a,* such that the drive shaft 11 rotates integrally with the crankshaft 36. At a location below the flywheel 56, a trochoid type oil pump 58 is provided, which is rotated by the driving power of the crankshaft 36.

Referring to, in particular, FIG. 3 and FIGS. 5 and 7(A) in combination, the flywheel 56, located below the engine body 3, is held in a flywheel chamber 59 defined by coupling a pump body 65 to the cylinder block 31 and the crankcase 30 with bolts (not shown). The flywheel chamber 59 includes a bottom wall 59*a* and an upper wall 59*b* opposing in the rotation axis direction (which is the direction in which the rotating axis L1 of the crankshaft 36 extends, and is simply referred to as the rotation axis direction hereunder), and a circumferential wall 60 located radially outward of the flywheel 56. The upper wall 59*b* is made up of the lower wall 31*a* of the cylinder block 31, lower seal cover 35 and bottom wall 30*a* of the crankcase 30. The lower wall 59*a* is made up of the pump body 65, and the circumferential wall 60 is made up of a coupling wall 61, which is a projecting wall downwardly projecting from the lower surface of the bottom wall 30*a* of the crankcase 30, a coupling wall 62, which is a projecting wall downwardly projecting from the lower surface of the lower wall 31*a* of the cylinder block 31 while surrounding the lower seal cover 35 from radially outside, and an outer circumferential wall 63 of the pump body 65.

As shown in FIG. 4, particularly, the circumferential wall 60 is a plane parallel to a reference plane P0 including the rotating axis L1 and perpendicular to the center axis L3 of the tilt shaft 16 (which reference plane P0 is a plane including the rotating axis L1 and the center axis L2 of the swivel shaft 14 as well), and with reference to a first plane P1 where its left side contacts the flywheel 56 and a second plane P2 where its right side contacts the flywheel 56, it includes a left wall portion 60*a* positioned leftward of the first plane P1, a right wall portion 60*b* positioned rightward of the second plane, a front wall portion 60*c* positioned forward between the first and second planes P1, P2, and a rear wall portion 60*d* positioned rearward between them.

Figure 5:
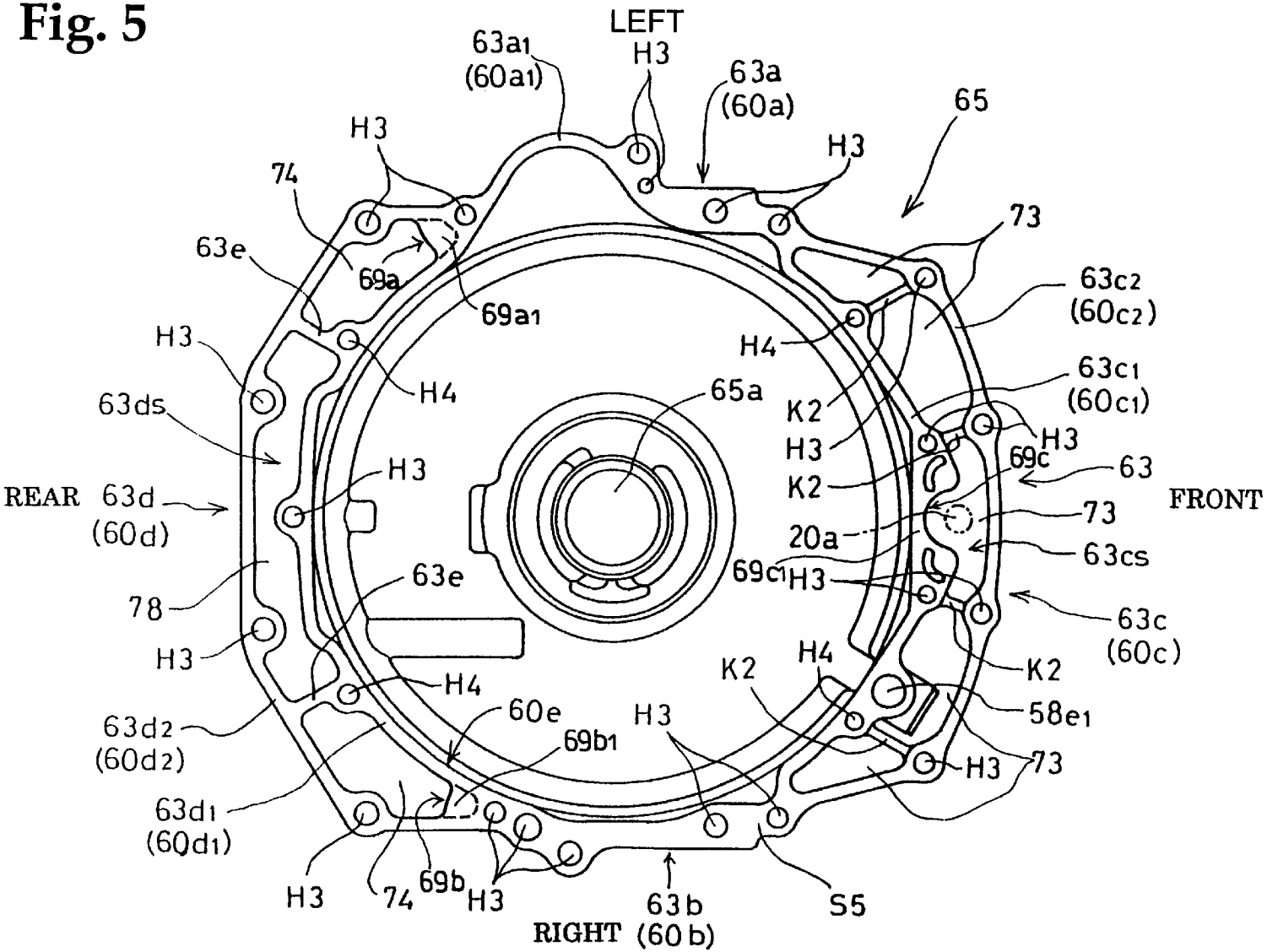
FIG. 5 is a top plane view of the pump body of an oil pump.

As shown in FIGS. 4, 5 and 7(A), the left wall portion 60*a* and the right wall portion 60*b,* which each are made of a single wall in the radial direction of the flywheel 56, are single-wall portions of the circumferential wall 60, and the front wall portion 60*c* and the rear wall portion 60*d,* which each are made up of double walls, namely, inner walls 60*c*1, 60*d*1 and outer walls 60*c*2, 60*d*2 separated by a distance in the radial direction of the flywheel 56, are double-wall portions of the circumferential wall 60. Then, the left wall portion 60*a,* right wall portion 60*b,* front wall portion inner wall 60*c*1 and rear wall portion inner wall 60*d*1 make up the inner circumferential wall forming an approximately circular inner circumferential wall surface 60*e* of the fly wheel chamber 59 having the rotating axis L1 as its center in its plan view.

As shown in FIGS. 5 through 7(A), the oil pump 58 includes a pump body 65 having a hole 65*a* liquid-tightly receiving the drive shaft 11 therethrough, and a pump cover 66 fixed on the lower surface of the pump body 65 by threading engagement. The oil pump 58 further includes an inner rotor 58*a* coupled to the spline piece 57 for integral rotation such that the crankshaft 36 functions as the pump drive shaft, and an outer rotor 58*a* that rotates in sliding contact with the inner rotor 58*b*. Both rotors 58*a,* 58*b* are located in a rotor accommodating chamber defined by the pump body 65 and the pump cover 66, and a plurality of pump chambers 58*c* each with a space variable in volume are made between the rotors 58*a,* 58*b*.

Figure 6:
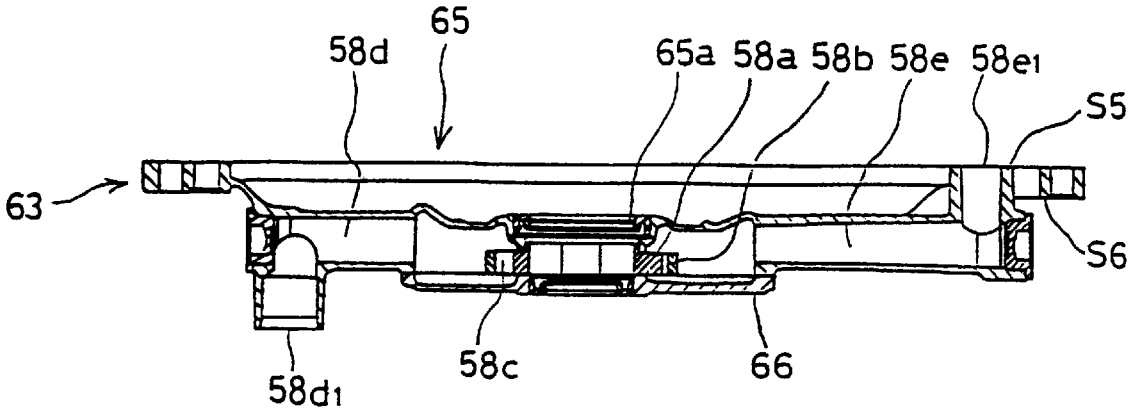
FIG. 6 is a cross-sectional view taken along the VI—VI line of FIG. 7(A)
Figure 7:
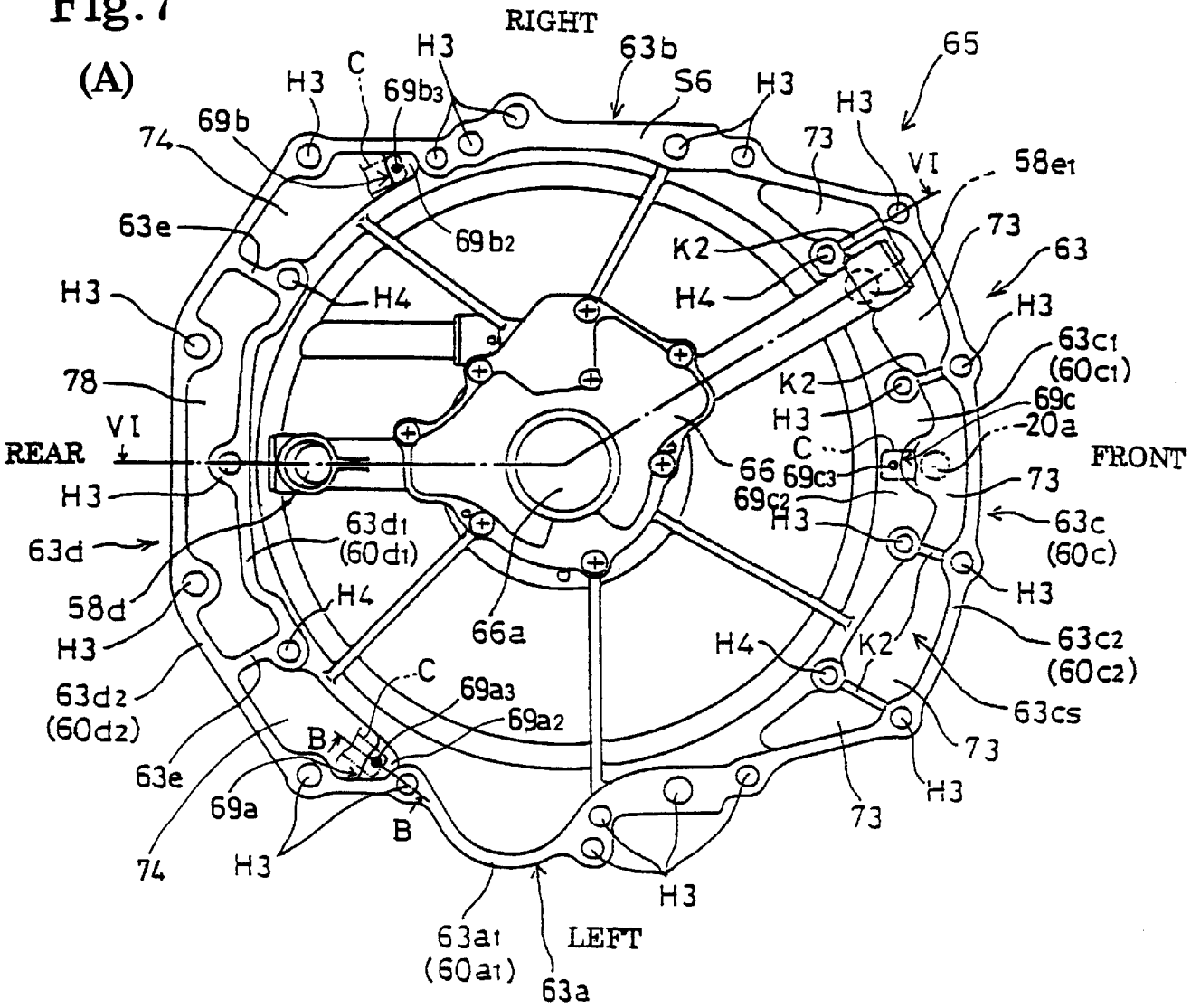
FIG. 7(A) is a bottom view of a pump body of an oil pump.
FIG. 7(B) is a sectional view taken along the B—B line of FIG. 7(A)
Figure 7:
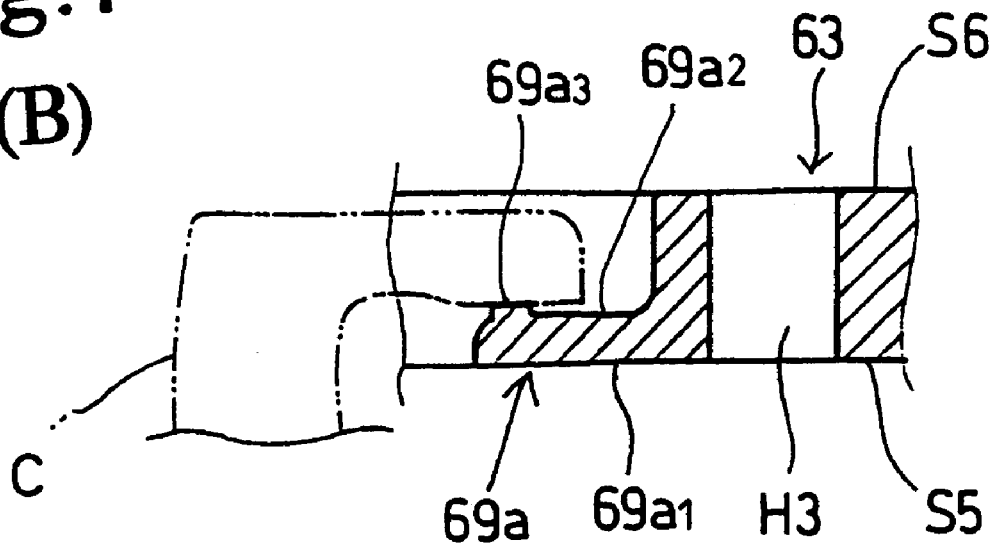

Further referring to FIG. 6, the pump body 65 has formed a suction port 58*d* and a release port 58*e*. Connected to the inlet opening 58*d*1 of the suction port 58*d* is the upper end of an oil suction tube 23 extending downward inside the oil pan 5 located below the flywheel 56. The outlet opening 58*e*1 of the release port 58*e* opens at a fitting surface S5 of the outer circumferential wall 63, and it is connected to the inlet opening 85*a* of the case oil path 85 opening at a fitting surface S3 of the crankcase 30, which will be explained later (see FIG. 4).

Figure 8:
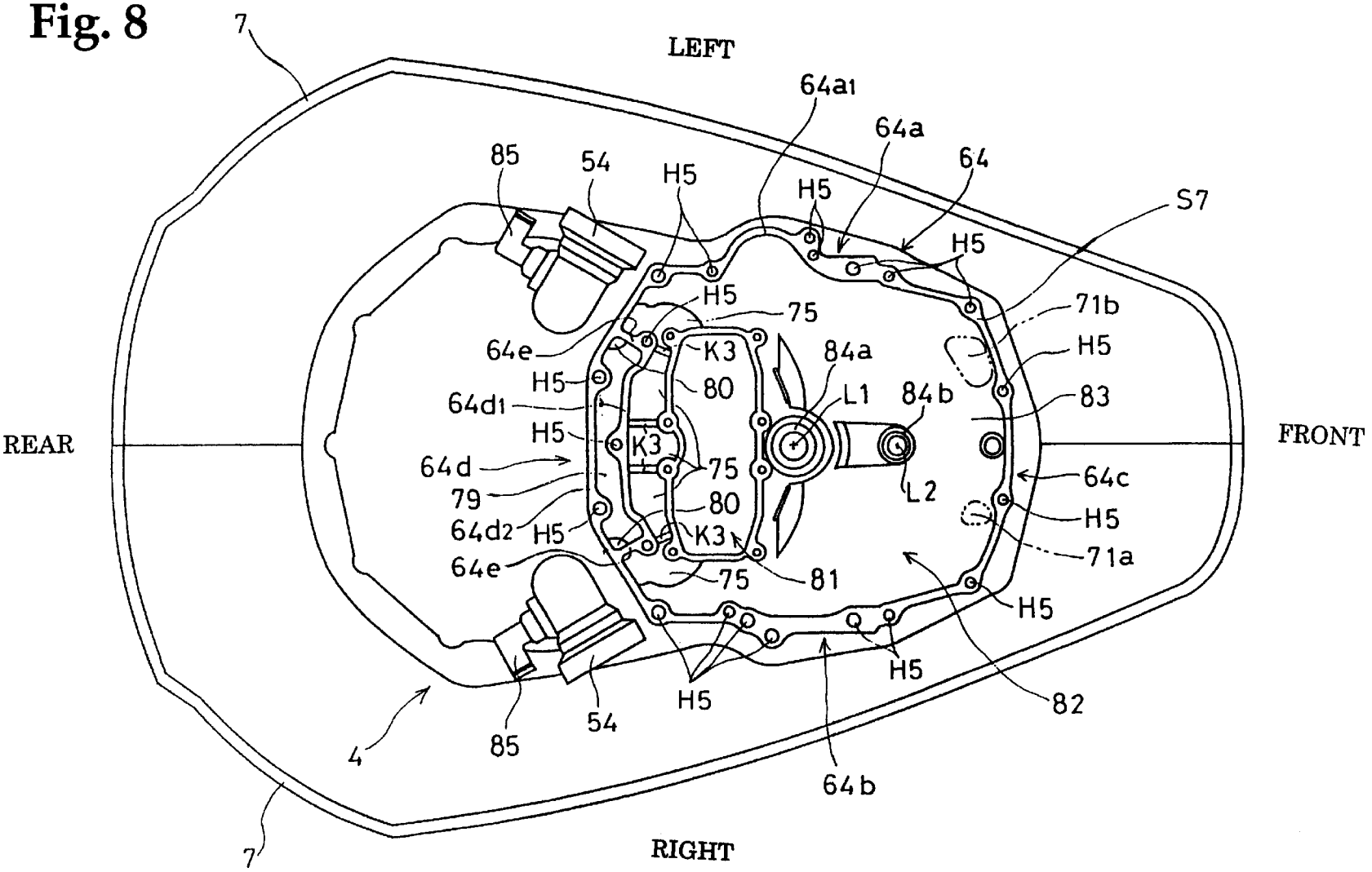
FIG. 8 is a top plane view of a mount case.
Figure 9:
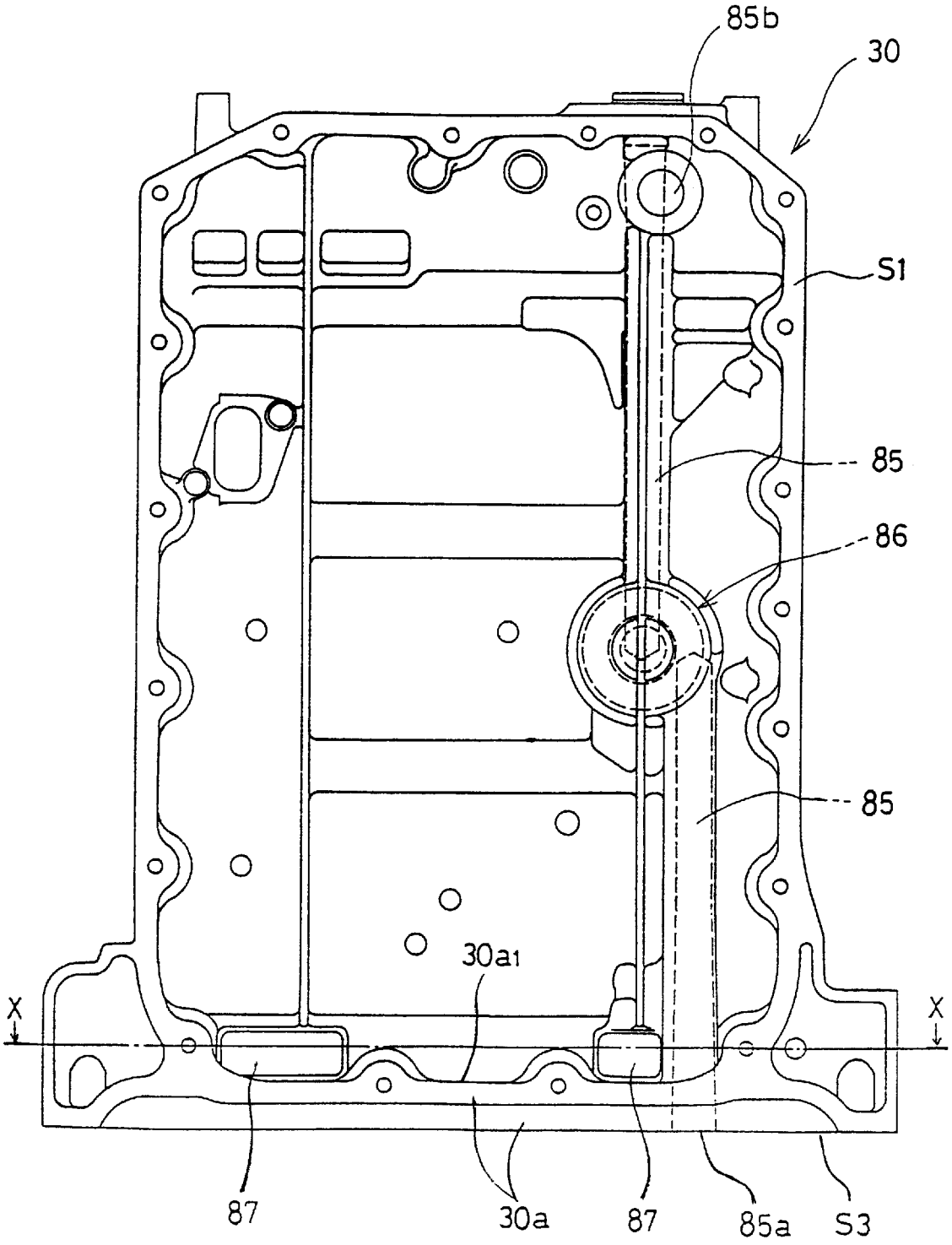
FIG. 9 is a view of the crankcase taken from its surface for contact with the cylinder head.

The engine body 3 is united to the mount case 4 through the pump body 65 with a plurality of bolts B2 (one of which is shown in FIG. 3) and supported thereby. More specifically, the engine body 3 is united to an annular support wall 64 as a support portion of the mount case 4 through the outer circumferential wall 63 as the outer circumferential portion of the pump body 65 with a number of bolts B2 applied to the coupling walls 61, 62 as coupling portions for coupling to the mount case 4. Referring below to FIGS. 3 and 8, explanation is made about these coupling walls 61, 62, outer circumferential wall 63 and support wall 64 forming the support structure of the engine body 3, and pathways formed in these portions.

Referring to FIGS. 4 and 5, lower end surfaces of the cylinder block 31 and the coupling walls 61, 62 of the crankcase 30 lie on a common plane. These lower end surfaces form fitting surfaces S3, S4 (FIG. 4) having configurations mating with the fitting surfaces S5 (FIG. 5) that is the plane defined by the upper end surface of the outer circumferential wall 63 of the pump body 65.

The coupling wall 61 of the crankcase 30 will be explained below. As shown in FIG. 4, the coupling wall 61 is made up of the left coupling wall 61*a,* right coupling wall 61*b* and front coupling wall 61*c* which form the left wall portion 60*a,* right wall portion 60*b* and front wall portion 60*c* of the circumferential wall 60, respectively. The front coupling wall 61*c* includes an inner coupling wall 61*c*1 forming the front wall portion inner wall 60*c*1 of the circumferential wall 60, and an outer coupling wall 61*c*2 positioned at a distance radially outward and forward of the inner coupling wall 61*c*1 and forming the front wall portion outer wall 60*c*2. Thus a first return oil path 71 is formed in a space 61*s* in form of a recess defined by the crankcase bottom wall 30*a* as its upper wall between the inner coupling wall 61*c*1 and the outer coupling wall 61*c*2. The first return oil path 71 has a first inflow opening 71*a* and a second inflow opening 71*b* that are through holes formed in the bottom wall 30*a* of the crankcase 30. Further formed in the bottom wall 30*a* is an insertion hole 30*b* communicating with the space 61*s* and receiving the shifting shaft 20*a* having the center axis L2 on the reference plane P0 (see FIG. 3 as well). The first inflow opening 71*a* is positioned rightward of the insertion hole 30*b,* and its entirety opens at a location nearer to the reference plane P0 than the inflow opening 85*a* if the case oil path 85. The second inflow opening 71*b* is positioned leftward of the insertion hole 30*b,* and a part thereof opens at a location nearer to the reference plane P0 than the inflow opening 85*a.*

On the other hand, the coupling wall 62 of the cylinder block 31 is made up of a left coupling wall 62*a,* right coupling wall 62*b* and rear coupling wall 62*d* that form the left wall portion 60*a,* right wall portion 60*b* and rear wall portion 60*d* of the circumferential wall 60, respectively. Among them, the left coupling wall 62*a* has formed a bulging portion that bulges radially outward to form an accommodating portion 62*a*1 for accommodating a starter motor 67 having a pinion 67*a* in engagement with the ring gear 55. Additionally, the left outer circumferential wall 63*a* forming the left wall portion 60*a,* as explained later, and the left support wall 64*a* explained later have formed bulging portions 63*a*1, 64*a*1 of a shape mating with the accommodating portion 62*a*1.

The rear coupling wall 62*d* is made up of an inner coupling wall 62*d*1 forming the rear wall portion inner wall 60*d*1 of the circumferential wall 60 and an outer coupling wall 62*d*2 positioned at a distance radially outward and rearward of the inner coupling wall 62*d*1 to form the rear wall portion outer wall 60*d*2. Thus a first drainage path 76 in form of a recess having surfaces forming fitting surfaces S4 at right and left end portions that are positions intersecting with the reference plane P0 and having a pair of partition walls 62*e* is formed in a space 62*s* in form of a recess defined by the cylinder block lower wall 31*a* gas its upper wall between the inner coupling wall 62*d*1 and the outer coupling wall 62*d*2. Leftward and Rightward adjacent to the first drainage path 76, second return oil paths 72 in form of a through hole are formed. Each of the second return oil paths 72 communicates with a return passage (not shown) formed in the lower wall 31*a* of the cylinder block 31 and opening into the valve drive chamber 50. The lower wall 31*a* of the cylinder block 31 has formed a pair of inflow openings 77 making communication between the first drainage path 76 and a cooling water jacket of the cylinder block 31. K1 denotes a reinforcing rib.

The coupling walls 61, 62 have formed a plurality of bolt holes H1 opening at the fitting surfaces S3, S4 for engagement with a plurality of bolts B2 inserted into the support wall 64. Both inner coupling walls 61*c*1, 62*d*1 have formed four bolt holes H2 for engagement with four bolts for partly fixing the oil pump 58 to the coupling walls 61, 62 before the engine body 3 is united to the mount case 4.

Referring to FIG. 5, the outer circumferential wall 63 of the pump body 65 includes left outer circumferential wall 63*a,* right outer circumferential wall 63*b,* inner circumferential wall 63*c*1 and outer circumferential wall 63*c*2 of a front outer circumferential wall 63*c,* and inner circumferential wall 63*d*1 and outer circumferential wall 63*d*2 of a rear outer circumferential wall 63*d,* which corresponds, respectively, to the left coupling walls 61*a,* 62*a,* right coupling walls 61*b,* 62*b,* of the coupling walls 61, 62, inner coupling wall 61*c*1 and outer coupling wall 61*c*2 of the front coupling wall 61*c,* and inner coupling wall 61*d*1 and outer coupling wall 61*d*2 of the front coupling wall 61*d.* The left outer circumferential wall 63*a,* right outer circumferential wall 63*b,* inner circumferential wall 63*c*1 and outer circumferential wall 63*c*2 of the front outer circumferential wall 63, and inner circumferential wall 63*d*1 and outer circumferential wall 63*d*2 of the rear outer circumferential wall 63*d* form, respectively, the left wall portion 60*a,* right wall portion 60*b,* front wall portion inner wall 60*c*1 and front wall portion outer wall 60*c*2 of the front wall portion 60*c,* and rear wall portion inner wall 60*d*1 and rear wall portion outer wall 60*d*2 of the rear wall portion 60*d.* K2 denotes a reinforcing rib.

In the space 63*cs* defined by a through hole between the inner circumferential wall 63*c*1 and the outer circumferential wall 63*c*2 of the front outer circumferential wall 63*c,* a third return oil path 73 is formed as a through hole having a mating shape with the first return oil path 71. In the space 63*ds* defined between the inner circumferential wall 63*d*1 and the outer circumferential wall 63*d*2 of the rear outer circumferential wall 63*d,* a second drainage path 78 and fourth return oil paths 74 are provided in form of through holes of mating shapes with the first drainage path 76 and the second return oil paths 72.

Referring to FIG. 7(A), while the fitting surface S5 of the pump body 65 mates with the fitting surfaces S3, S4 as explained above, the lower end surface of the pump body 65 forms a fitting surface S6 of a shape mating with a fitting surface S7 that is the upper end surface of the support wall 64 of the mount case 4. The fitting surface S6 is made up of lower end surfaces of the left outer circumferential wall 63*a,* right outer circumferential wall 63*b,* outer circumferential wall 63*c*2 of the front outer circumferential wall 63*c* and outer circumferential wall 63*d*2 of the rear outer circumferential wall 63*d,* and lower end surfaces of a part of the inner circumferential wall 63*d*2 and right and left partition walls that define the second drainage path 78.

The left outer circumferential wall 63*a,* right outer circumferential wall 63*b,* outer circumferential wall 63*c*2 of the front outer circumferential wall 63*c* and outer circumferential wall 63*d*2 of the rear outer circumferential wall 63*d* have a plurality of through holes H3 opening to both fitting surfaces S5 and S6 to receive a plurality of bolts B2 that are inserted through the support wall 64 for engagement with bolt holes Hi of the coupling walls 61, 62. Also the both inner circumferential walls 63*c*1, 63*d*1 have four through holes H4 that receive those four bolts for partly fixing the oil pump 58.

Referring to FIGS. 5, 7(A) and 7(B), at positions inside the fitting surfaces S5 and S6 that form annularly continuous sealing surfaces of the pump body 65, there are provided a plurality of seats having protrusions on which are abutted clamps C used for fixing the pump body 65 to a jig (not shown) during the operation for grinding the fitting surfaces S5 and S6. These seats having protrusions are formed at circumferentially and substantially equally spaced locations and at radially outer positions of the flywheel chamber 59. More specifically, in this embodiment, the pump body 65 is formed with a shelve-like seat 69*a,* a shelve-like seat 69*b* and a seat 69*c*. The shelve-like seat 69*a* is formed at an end portion of the fourth return oil path 74 adjoining the left side of the second drainage path 78 in a manner to connect the inner and outer circumferential walls 63*d*1 and 63*d*2. The shelve-like seat 69*b* is formed at an end portion of the fourth return oil path 74 adjoining the right side of the second drainage path 78 in a manner to connect the inner and outer circumferential walls 63*d*1 and 63*d*2. The seat 69*c* is formed on the inner circumferential wall 63*c*1 in the region where the inner circumferential wall 63*c*1 intersects the reference plane P0. The seats 69*a,* 69*b* and 69*c* have upper surfaces 69*a*1, 69*b*1 and 69*c*1 and lower surfaces 69*a*2, 69*b*2 and 69*c*2, respectively. The upper surfaces 69*a*1, 69*b*1 and 69*c*1 are formed on the same plane as the fitting surface S5 at locations not interfering with a seal member (not shown) which is provided on the fitting surface S5, while the lower surfaces 69*a*2, 69*b*2 and 69*c*2 are formed to recede from the fitting surface S6. The lower surfaces 69*a*2, 69*b*2 and 69*c*2 of the seats 69*a*, 69*b* and 69*c* have protrusions 69*a*3, 69*b*3 and 69*c*3 formed thereon, respectively.

The fitting surfaces S5 and S6 are subjected to grinding operation as follows. First, the pump body 65 is fixedly held to a jig by making use of the hole 65*a* of the pump body 65, and the fitting surface S5 is formed on the pump body 65 by grinding. Thereafter, the pump body 65 is loosend and inverted and then fixedly held to the jig again by tightening the clamp C which is in abutment with the protrusions 69*a*3, 69*b*3 and 69*c*3. Then, the fitting surface S6 and the surface to which the pump cover 66 is liquid-tightly joined is formed by grinding operation.

Next referring to FIG. 8, the mount case 4 has the support wall 64 that projects upward such that the coupling walls 61, 62 are united thereto together with the outer circumferential wall 63 with a plurality of bolts B2 while the outer circumferential wall 63 of the pump body 65 is sandwiched between the coupling walls 61, 62. When those bolts B2 are fixed, the fitting surfaces S3, S4 liquid-tightly contact with the fitting surface S5, and the fitting surface S6 with the fitting surface S7. Therefore, the fitting surfaces S3 through S7 serve as sealing surfaces. The support wall 64 includes an annular outer support wall made up of a left support wall 64*a*, right support wall 64*b*, front support wall 64*c* and outer wall 64*d*2 of the rear support wall 64*d* that correspond respectively to the left outer circumferential wall 63*a*, right outer circumferential wall 63*d*, outer circumferential wall 63*c*2 of the front outer circumferential wall 63*c* and outer circumferential wall 63*d*2 of the rear outer circumferential wall 63*d*, and includes an inner wall 64*d*1 of the rear support wall 64*d* and a partition wall 64*e* that correspond, respectively, to a part of the inner circumferential wall 63*d*1 and the partition wall 63*e* defining the second drainage path 78. The outer support wall and the innerwall 64*d*1 have a plurality of through holes H5 for receiving a plurality of bolts B2 applied through the support wall 64.

Since the mount case 4 having the above-explained support wall 64 supports the engine body 3 by means of the coupling walls 61, 62, the pump body 65 is integrally united to the mount case 4 together with the engine body 3 by applying a plurality of bolts B2 inserted through the through holes H5, H3 made in the support wall 64 and the outer circumferential wall 63 and fixing them into the bolt holes H1 made in the coupling walls 61, 62 while the outer circumferential wall 63 of the pump body 65 is sandwiched between the coupling walls 61, 62, and the support wall 64, and while the left coupling walls 61*a*, 62*a* of the coupling walls 61, 62, right coupling walls 61*b*, 62*b*, both outer coupling walls 61*c*2, 62*d*2, left outer circumferential wall 63*a* of the outer circumferential wall 63, right outer circumferential wall 63*b*, both outer circumferential walls 63*c*2, 63*d*2 and the outer support wall of the support wall 64 overlap substantially entirely in the rotation axis direction. The support wall 64 of the mount case 4, outer circumferential wall 63 and coupling walls 61, 62 of the pump body 65 make up the coupling portion for coupling the engine body 3 to the mount case 4 through the pump body 65, and the outer diameter of the support wall 64, throughout its entire circumference including the outer diameter in the right and left direction, is substantially equal to the outer diameter of the coupling walls 61, 62 and the outer circumferential wall 63 making up the circumferential wall 60 of the flywheel chamber 59. Therefore, the outer diameter of the circumferential wall 60 in the right and left direction is regulated by the left coupling walls 61*a*, 62*a* and the left outer circumferential wall 63*a*, and by the right coupling walls 61*b*, 62*b* and the right outer circumferential wall 63*b*, whereas the outer diameter of the circumferential wall 60 in the front and rear direction is regulated by the outer coupling wall 61*c*2 of the front coupling wall 61*c* and the outer circumferential wall 63*c*2 of the front outer circumferential wall 63*c* and by the outer coupling wall 62*d*2 of the rear coupling wall 62*d* and the outer circumferential wall 63*d*2 of the rear outer circumferential wall 63*d*.

The mount case 4 also has a third drainage path 79 in form of a recess of a shape corresponding to the second drainage path 78, and at right and left end portions thereof, a pair of drainage holes 80 are provided to communicate with a drainage tube (not shown) connected to the lower surface of the mountcase 4. Then an accommodating chamber 81 is provided in front of the third drainage path 79 to accommodate mount rubber R1 that permits a stud bolt B1 for uniting the swivel shaft 14 and the mount case 4 to pass through, and a fifth return oil path 75 in form of a through hole is provided between the accommodating chamber 81 and the third drainage path 79 to permit the lubricant oil to drop into the oil pan 5. At the portion of the fifth return oil path 75 intersecting with the reference plane P0, the oil suction tube 23 (see FIG. 2) is inserted. Coupling of the support wall 64 and the pump body 65 results in defining a return oil collection chamber 82 having the pump body 65 and the pump cover 66 as its upper wall and having the mount case 4 as its lower wall. Inside the collection chamber 82, the upper surface of the mount case 4 has formed holes 84*a*, 84*b* surrounded by the support wall 64 and allowing the drive shaft 11 and the shifting shaft 20*a* to pass through liquid-tightly. The upper surface of the mount case 4 inside the collection chamber 82 serves as a guide surface 83 that receives lubricant oil dropping from the first and third return oil paths 71, 73 and guiding it into the fifth return oil path 75. Further, most of the lubricant oil dropping from the second and fourth return oil paths 72, 74 drops into the oil pan 5 from the right side end of the fifth return oil path 75.

Behind the support wall 64, a pair of exhaust pipes 54 are provided to be connected to the exhaust manifold 53 of both banks of the cylinder block 31, and cooling water from the cooling water supply pipe 24 (see FIG. 2) , through which cooling water pumped out from a water pump, not shown, travels, is supplied from the cooling water path running above the oil pan 5 through the path around the exhaust pipe 54 and through the joint 85 to the cooling water jacket of the cylinder block 31 and the cylinder head 32.

In this fashion, the support wall 64 of the mount case 4 is united to the coupling walls 61, 62, to which the outer circumferential wall 63 of the pump body 65 forming the flywheel chamber 59 is united, via the outer circumferential wall 63 with bolts B2, and thereby supports the engine body 3. Therefore, the coupling walls 61, 62, outer circumferential wall 63 and the support wall 64 are aligned with the first plane P1 and the second plane P2, and the left coupling walls 61*a*, 62*a* and the right coupling walls 61*b*, 62*b* of the cylinder block 31 and the crankcase 30, and all of the left outer circumferential wall 63*a* and the right outer circumferential wall 63*b* of the outer circumferential wall 63 of the pump body 65, and the left support wall 64*a* and the right support wall 64*b* of the support wall 64 form a single wall substantially uniform in outer diameter in the right and left direction. As a result, the outer diameter of the coupling walls 61, 62, outer circumferential wall 63 and support wall 64 in the right and left direction can be minimized within the range sufficient for the circumferential wall 60 to accommodate the flywheel 56. Responsively, in accordance with the outer diameter of the single wall in the right and left direction, the undercover 7 covering it from radially outside and the engine cover 8 united to the undercover 7 can be decreased in dimension in the right and left direction.

Next, the lubricating system will be described with reference to FIGS. 2 and 9 through 11. The case oil path 85 introducing lubricant oil released from the release port 58*e* (FIG. 6) of the oil pump 58 extends vertically in a right half portion of the crankcase 30, and the outflow opening 85*b* at the upper end thereof communicates with a cover oil path (not shown) made in the upper seal cover 34. In a midway of the case oil path 85, an oil filter 86 (see FIG. 2) attached to the front face of the crankcase 30 forming the front portion of the engine body 3 is located such that lubricant oil introduced from the inflow opening 85*a* and freed from foreign matters by the oil filter 86 flows toward the outflow opening 85*b*.

The cover oil path, explained above, communicates with a block oil path (not shown) forming the main gallery provided at the portion forming the V-shaped valley portion of the cylinder block 31, and the block oil path communicates with a head oil path (not shown) formed in the cylinder head 32. Thus the lubricant oil in the block oil path is supplied to four journal portions of the crankshaft 36, and a part of lubricant oil supplied from the journal portion is supplied to, among others, the coupling portion between the crank pin and the large end portion of the connection rod 43 via an oil hole made inside the crankshaft 36 to lubricate sliding portions of the crankshaft 36 and other sliding portions of members existing inside the crank chamber 37. At the same time, it is supplied to sliding portions of the valve driving mechanism V in the valve drive chamber 50 via the head oil path and lubricates the siding portions.

Therefore, the case oil path 85, cover oil path, block oil path and head oil path make up the supply oil path for supplying lubricant oil released from the oil pump 58 to various portions of the engine body 3 to be lubricated, such as those sliding portions, for example, and among them, the case oil path 85 formed in the crankcase 30 forming the front portion of the engine body 3 makes up the front supply oil path.

Figure 10:
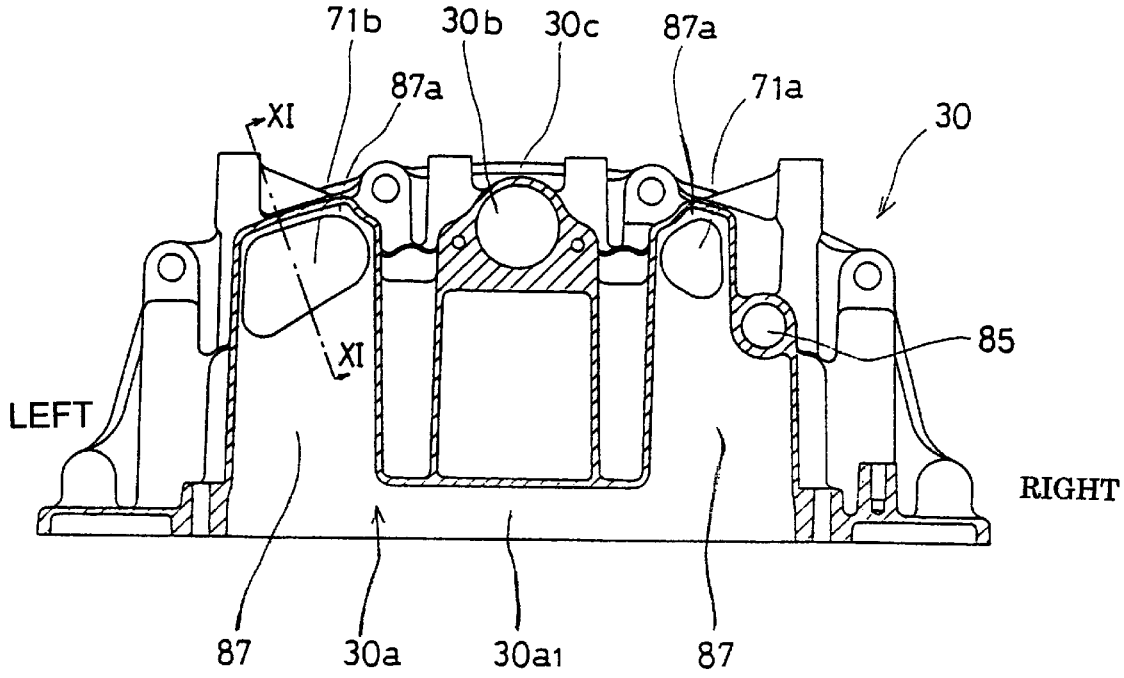
FIG. 10 is cross-sectional view taken along the X—X line of FIG. 9.
Figure 11:
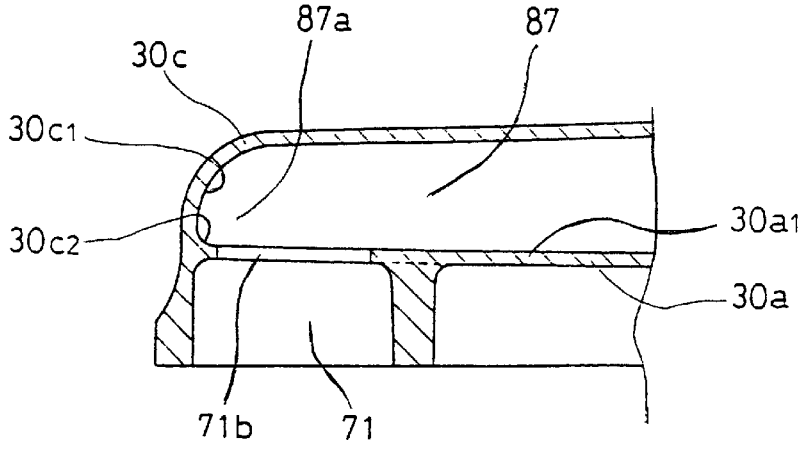
FIG. 11 is a cross-sectional view taken along the XI—XI line of FIG. 10.

The lubricant oil after lubricating sliding portions inside the crank chamber 37 drop on the upper surface of the lower seal cover and the upper surface of the bottom wall 30*a* (FIG. 3) of the crankcase 30. A part of the lubricant after lubricating sliding portions inside the valve drive chamber 50 flows into the crank chamber 37 via the return oil path made in the cylinder block 31 and a plurality of breather paths (not shown) and drops onto the upper surface of the lower seal cover 35. As shown in FIGS. 10 and 11, the lubricant oil flowing down or dropping onto the upper surface of the lower seal cover 35 and the upper surface of the bottom wall 30*a* of the crankcase 30 then drops onto the guide surface 83 (FIG. 8) through the return oil path made up of the first return oil path 71 having the first and second inflow openings 71*a*, 71*b* opening at the bottom wall 30*a* and the third return oil path 73 (FIG. 3) of the outer circumferential wall 63, and thereafter drops into the oil pan 5 through the fifth oil path 75 of the mount case 4.

As best shown in FIG. 11, the first and second inflow openings 71*a*, 71*b* are made in the bottom wall 30*a* in proximity of a rising start end 30*c*2 of the front wall 30*c* having an inner wall surface 30*c*1 that rises from the upper surface 30*a*1 of the bottom wall 60*a* in the front-most portion 87*a* of a projection space 87 defined by the upper surface 30*a*1 of the bottom wall 30*a* of the crankcase 30 and the inner wall surface 30*c*1 of the front wall 30*c* to project forward. The proximity of the rising start portion 30*c*2 herein means positions of the first and second inflow openings 71*a*, 71*b* providing a distance enough to prevent lubricant oil from staying between the first and second inflow openings 71, 71*b* and the rising start portion 30*c*2, which ever the rising start portion 30*c*2 partly forms the openings of the first and second inflow openings 71*a*, 71*b*, or not.

In this manner, since the first and second inflow openings 71*a*, 71*b* make up the front-most portion 87*a* of the projection space 87 and are located in proximity of the rising start portion 30*c*2, even when the engine body 3 inclines forward during operation under a condition where the outboard engine 1 is tilted up, such as during cruising of the boat in shallow water, almost all of the lubricant oil flowing on the bottom wall 30*a* can flow into the first and second inflow openings 71*a*, 71*b* without staying on the bottom wall 30*a*, then can drop onto the guide surface 83 from the first return oil path 71 through the third return oil path 73 of the outer circumferential wall 63, and can drop into the oil pan 5 through the fifth return oil path 75.

On the other hand, lubricant oil from the valve drive chamber 50 flows through a rear return oil path made up of the second return oil paths 72 (FIG. 4) and the fourth return oil paths 74 (FIG. 7A) and through the fifth return oil path 75 (FIG. 8), and drops into the oil pan 5. Part of the lubricant oil already lubricating sliding portions inside the valve drive chamber 50, other than the part flowing out to the crank chamber 37, runs through the return tube 25 (see FIG. 2) attached to the head cover 33 and drops into the oil pan 5. Therefore, the first to fifth return oil paths 71 through 75, return passage and return tube 25 make up a return oil path that guides the lubricant oil supplied to those portions to be lubricated back to the oil pan 5.

Next, operation and effects of the embodiment having the above-explained configuration will be explained.

Lubricant oil present in the crank chamber 37 after lubricating portions of the engine 2 to be lubricated flows down or drops onto the bottom wall 30*a* of the crankcase 30 and the upper surface of the lower seal cover 35, then flows along the upper surface 30*a*1 of the bottom wall 30*a* forming the upper wall 59*b* of the flywheel chamber 59, or flows first along the upper surface of the lower seal cover 35 and then along the bottom wall 30*a*, and flows into the first return oil path 71 from the first and second inflow openings 71*a*, 71*b*, exiting from the crank chamber 37, until finally returning back to the oil pan 5 through the third and fifth return oil paths 73, 75. Thus, during operation under a condition where the outboard engine 1 is tilted up, such as during cruising of the boat in shallow water, the lubricant oil flowing on the bottom wall 30*a* inclined down frontward flows into the first return oil path 71 having the first and second inflow openings 71*a*, 71*b* located forward of the inner circumferential wall 60*c* of the flywheel chamber 59. As a result, during operation under a tilt-up condition, it is ensured that substantially no or only minimum lubricant oil stays on the bottom wall 30*a*. Therefore, unlike the conventional techniques, there is no need of increasing the quantity of lubricant oil retained in the oil pan 5, which will be required to be larger in capacity, taking account of the quantity of lubricant oil that will stay in the crank chamber 37. Accordingly, the oil pan 5 can be decreased in size and weight, and the outboard engine 1 can be decreased in size and weight as well. Further, since it is substantially prevented that the crankshaft 36 stirs lubricant oil staying in the crank chamber 37, output loss by agitation of lubricant oil can be prevented. Furthermore, since substantially no or only an extremely small amount of lubricant oil stays in the crank chamber 37, the first return oil path 71 and the third return oil path 73, as well as the first and second inflow openings 71*a,* 71*b,* need not be increased in diameter for the purpose of ensuring smooth outflow of lubricant oil from the crank chamber 37 including the lubricant oil having stayed there, immediately after the tilt-up condition is canceled, the first and third return oil paths 71, 73 including the first and second inflow openings 71*a,* 71*b* can be decreased in diameter in comparison to those of the conventional techniques, and the outboard engine 1 can be made compact and lightweight so much.

The left wall portion 60*a* and the right wall portion 60*b* forming a part of the circumferential wall 60 of the flywheel chamber 59 are made up of single wall portions, i.e. single-layered walls in the radial direction of the flywheel 56. Therefore, outer diameter of the flywheel chamber 59 decreases in the right and left direction, and accordingly, the outboard engine 1 decreases in width in the right and left direction, thereby contributing to making the outboard engine 1 compact and increasing the freedom of location thereof on the boat stern T. Furthermore, since the first and third return oil paths 71, 73 are made by making use of the spaces 61*s,* 63*cs* between the front wall portion inner wall 60*c*1 and the front wall portion outer wall 60*c*2 of the circumferential wall 60 of the flywheel chamber 59, it is prevented that the bottom wall 30*a* of the crankcase 30 becomes excessively large in the front and rear direction to make the first and third return oil paths 71, 73, and the outboard engine 1 can be reduced in size and weight.

The first and second inflow openings 71*a,* 71*b* formed in the bottom wall 30*a* of the crankcase 30, which is located in front of the cylinder block 31 to make up the front portion of the engine body 3, open in proximity of the rising start portion 30*c*2 of the front-most portion 87*a* of the projection space 87. Therefore, when the outboard engine 1 is driven under a tilt-up condition, lubricant oil flowing on the bottom wall 30*a* inclining down forward flows toward the front-most portion 87*a* that is positioned in the lowest level, and flows into the first and second inflow openings 71*a,* 71*b* formed in proximity of the rising start portion 30*c*2 of the front wall 30*c*. As a result, substantially no or only an extremely small quantity of lubricant oil stays in the crank chamber 37, and the effect of the embodiment is further enhanced in compact and light weight design of the outboard engine 1 and prevention of output loss.

In the bottom wall 30*a* of the crankcase 30, the first and second inflow openings 71*a,* 71*b* are provided at locations in proximity of the reference plane P0 that is the center plane of the crankcase 30 in the right and left direction, without any restriction from the case oil path 85 formed in the bottom wall 30*a* of the crankcase 30. Therefore, the first and second inflow openings 71*a,* 71*b* are disposed at positions of the bottom wall 30*a* of the crankcase 30 near the reference plane P0, where lubricant oil from peripheral portions distant from the reference plane P0 is most likely to gather, that is, at optimum positions for the first and second inflow openings 71*a,* 71*b.*

Outer diameter of the coupling portions from the support wall 64 of the mount case 4 to the outer circumferential wall 63 of the pump body 65 and coupling walls 61, 62 of the crankcase 30 and the cylinder block 31 collectively, is substantially equal to the outer diameter of the circumferential wall 60 of the flywheel chamber 59. Therefore, in the outboard engine 1 in which the engine body 3 is united to the mount case 4 through the pump body 65, the outer diameter of the coupling portions can be minimized within a range sufficient for the circumferential wall 60 to accommodate the flywheel 56, and the outboard engine 1 can be further reduced in size and weight.

The left coupling walls 61*a,* 62*a,* right coupling walls 61*b,* 62*b* and outer coupling walls 61*c*2, 62*d*2 of the coupling walls 61, 62, left outer circumferential wall 63*a,* right outer circumferential wall 63*b,* outer circumferential wall 63*c*2 and outer circumferential wall 63*d*2 of the outer circumferential wall 6*e,* and outer support wall of the support wall 64 are united together so as to overlap substantially entirely in the rotation axis direction. Therefore, it is not necessary to make the coupling walls and the support wall as surrounding the outer circumference of the pump body 65. This contributes to minimizing the diameter of the coupling walls 61, 62, outer circumferential wall 63 and support wall 64, which are coupling portions of the engine body 3 and the mount case 4, within a range sufficient for the pump body 65 forming the circumferential wall 60 of the flywheel chamber 59 to accommodate the flywheel 56, and hence contributes to reducing the size and weight of the outboard engine 1.

In addition to that, since the outer circumferential wall 63 of the pump body 65 is disposed to overlap the coupling walls 61, 62 and the support wall 64 in the rotation axis direction as explained above, regardless of the coupling walls 61, 62 being united to and supported by the support wall 64 via the pump body 65, weight of the engine 2 acting upon the outer circumferential wall 63 via the coupling walls 61, 62 is withheld by the support wall 64 of the mount case 4 via the outer circumferential wall 63, and it is prevented that a bending moment caused by the weight acts on the pump body 65. As a result, the pump body 65 is prevented from being deformed by such a bending moment caused by the weight, and the pump body 65 need not be increased in rigidity for the purpose of preventing such deformation. Thus, also in this respect, the pump body 65 can be reduced in weight, and the outboard engine 1 can be decreased in weight as well.

The left wall portion 60*a* and the right wall portion 60*b* forming a part of the circumferential wall 60 of the flywheel chamber 59, which is made up of the outer circumferential wall 63 and the coupling walls 61, 62, are made up of singular wall portions, i.e. single-layered walls in the radial direction of the flywheel 56, and at the same time, outer diameter of the coupling walls 61, 62 forming the circumferential wall 60, of course, and of the support wall 64 in the right and left direction is substantially equal to the outer diameter of the circumferential wall 60 in the right left direction defined by the left wall portion 60*a* and the right wall portion 60*b*. Therefore, it is possible to minimize the outer diameter of the coupling walls 61, 62, outer circumferential wall 63 and support wall 64 in the right and left direction within a range sufficient for the pump body 65 forming the flywheel chamber 59 to accommodate the flywheel 56. As a result, during right and left rotation of the outboard engine 1 about the swivel shaft 14, the under cover 7 and other members are prevented from interfering with external members in the right left direction of the coupling portions, which contributes to reducing the sizes of the under cover 7 covering the coupling portions, and the engine cover 8 in the right and left direction, preventing the undercover 7 and other members from interfering with external members in the right and left direction of the coupling portions during right and left rotation of the outboard engine 1 about the swivel shaft 14, increasing the steering angle, and improving the maneuver ability. Moreover, also in case of a double engine construction in which outboard engines are fixed in parallel to a boat stern, it is possible to prevent those outboard engines from interfering with each other near that portion and to provide a large steering angle.

The front wall portion 60*c* and the rear wall portion 60*d* of the circumferential wall 60 of the flywheel chamber 59 made up of the outer circumferential wall 63 and the coupling walls 61, 62 are in form of double-wall portions, i.e. double walls distant in the radial direction of the flywheel 56, outer circumferential wall 63. At the same time, outer diameter of the coupling walls 61, 62 forming the circumferential wall 60, of course, and of the support wall 64, in the right and left direction, is substantially equal to the outer diameter of the circumferential wall 60 in the front and rear direction as defined by the front wall portion 60*c* and the rear wall portion 60*d*. Therefore, regardless of the outer diameter of the support wall 64 in the right and left direction being small, the support strength is improved, thereby to ensure sufficient support strength of the engine body 3, increase the region of the engine body 3 supported by the support wall 64, which makes it possible to support the engine body 3 more reliably.

Since the seats 69*a*, 69*b* and 69*c* are provided inside the fitting surfaces S5 and S6 of the pump body 65, that is, radially inward of the pump body 65, to support the jig for fixing the pump body 65 during the machining of the pump body 65, layout of parts and auxiliary machineries disposed radially outside of the pump body 65 is not limited by the seats 69*a*, 69*b* and 69*c*, so that the freedom of layout of the parts and auxiliary machineries is enlarged.

Explanation will be made below about embodiments partly modified from the foregoing embodiment, focusing at modified configurations.

The upper wall 59*b* of the flywheel chamber 59 can be made only of members forming the bottom wall of the crank chamber, or may be made of a cylinder block and a crankcase not having skirt portions.

The foregoing embodiment has been explained as the coupling portion being made up of the coupling walls 61, 62 in form of projecting walls of the cylinder block and the crankcase; however, the coupling portion need not project.

Although the foregoing embodiment has been explained as the engine 2 being a V-type cylinder engine, it may be a serially aligned multi-cylinder engine.

Although the present embodiment of the invention has been described in detail, it will be understood by persons skilled in the art that variations and modifications may be made thereto without departing from the gist, spirit or essence of the invention.

What is claimed is:

1. An outboard engine comprising:

an outboard engine body;

an engine provided in the outboard engine body, said engine including a crank case defining a crank chamber, a crankshaft provided within the crank chamber and extending vertically in the engine, a flywheel chamber provided below the crank chamber and having an upper wall forming a bottom wall of said crank case and a circumferential wall depending from the bottom wall of the crank case, a flywheel fixed to a lower end of the crankshaft and accommodated in the flywheel chamber, an oil pump driven by the crankshaft, a drive shaft driven by said crank shaft and extending vertically downward, an oil pan positioned below said flywheel and rearward of said drive shaft, a supply oil path that supplies lubricant oil discharged from the oil pimp to a portion of said engine to be lubricated, and a return oil path that returns the lubricant oil supplied to said portion to be lubricated to said oil pan; and a mount device adapted to mount the outboard engine body to a boat stern at a forward end of the engine of the engine body and having a tilt shaft about which the engine body can be tilted relative to the boat stern;

said bottom wall of the crank case having defined there through an oil inflow opening forming a part of said return oil path, said oil inflow opening being positioned at a foremost location of the crank chamber and forward of an inner circumferential surface of said circumferential wall of the flywheel chamber.

2. An outboard engine according to claim 1, further comprising:

a mount case supporting said crank case thereon and fixed between the crank case and the oil pan, said mount case having a collection chamber with a guide surface that defines a bottom of the collection chamber and has an oil return opening, said inflow opening being in communication with said collection chamber, and said oil return opening being in communication with the oil pan.

3. An outboard engine according to claim 2, wherein said collection chamber of the mount case is defined by a substantially annular, rising support wall, and said bottom wall of the crank case has a substantially annular, depending coupling wall, said support wall and said coupling wall being coupled with each other in superposing relation.

4. An outboard engine according to claim 2, wherein said oil return opening is provided at a rear position of the collection chamber, and said oil inflow opening is provided at a front position of the collection chamber.

5. An outboard engine according to claim 3, wherein said coupling wall depending from the bottom wall of the crank case and said circumferential wall of the flywheel chamber cooperate to form a front double wall portion in which said oil inflow opening is provided.

6. An outboard engine according to claim 2, wherein said crank chamber has a projection space projecting forward from the crank chamber and having a coplanar extension of said bottom wall, said oil inflow opening being provided at a foremost end of the projection space.

7. An outboard engine according to claim 6, wherein said projection space has an upstanding front wall at the foremost end thereof, said upstanding wall having a rising start portion connected to said extension of the bottom wall, said inflow opening being provided at a position close to the rising start portion.

8. An outboard engine according to claim 1 wherein said circumferential wall is made up of double-wall portions and single-wall portions, a left wall portion and a right wall portion of said circumferential wall are made up of said single-wall portions, a front wall portion of said circumferential wall is made up of said double-wall portion having an inner wall and an outer wall, and said inner wall and said outer wall of said front wall portion define a space therebetween, in which said return oil path is formed.

9. An outboard engine according to claim 1 wherein said engine body further includes a cylinder block, said crankcase is united to a front portion of said cylinder block to define said crank chamber, an inner wall surface rising from an upper surface of said bottom wall of said crank case cooperating with an upper surface of said bottom wall to define a projection space projecting forward in its plane view, and said inflow opening of said front return oil path opening in proximity of a rising start portion at a front-most portion of said projection space.

10. An outboard engine according to claim 9 wherein said supply oil path is disposed at a front portion of said engine, and said inflow opening is located nearer to a reference plane including a rotation axis of said crankshaft and perpendicular to said tilt shaft than said supply oil path in said bottom wall of said crankcase.

11. An outboard engine according to claim 1 wherein an outer circumferential wall of a pump body of said oil pump makes up said circumferential wall throughout the entire circumference thereof, said engine body being united to a support portion formed as a part of a mount case via said outer circumferential wall at a coupling portion formed as a part of said engine body, and said coupling portion, said outer circumferential wall and said support portion being substantially equal in outer diameter.

* * * * *

UNITED STATES PATENT AND TRADEMARK OFFICE

CERTIFICATE OF CORRECTION

PATENT NO. : 6,527,604 B2
DATED : March 4, 2003
INVENTOR(S) : Masanori Tsubouchi et al.

It is certified that error appears in the above-identified patent and that said Letters Patent is hereby corrected as shown below:

Column 2,
Line 42, change “cranks” to -- crank --.

Column 3,
Line numbered between 20 and 21, change “he outer” to -- the outer --.

Column 4,
Line 21, change “makeup” to -- make up --.
Line 37, change “potion” to -- portion --.
Line 66, after “is” insert -- a --.

Column 5,
Line 40, change “read end” to -- rear end --.
Line 41, change “amount” to -- a mount --.
Line 49, change “right end left” to -- right and left --.

Column 6,
Line 52, change “the those” to -- the --.

Column 8,
Line 12, change “outer rotor 58*a*” to -- outer rotor -- 58*b* --.
Line 13, change “inner rotor 58*b*” to -- outer rotor -- 58*a* --.

Column 9,
Line 5, change “if” to -- in --.
Line 34, change “gas” to -- as --.
Line 36, change “Rightward” to -- rightward --.

Column 10,
Line 40, change “Hi” to -- H1 --.

Column 11,
Line 12, change “loosend” to -- loosened --.
Line 39, change “innerwall” to -- inner wall --.

UNITED STATES PATENT AND TRADEMARK OFFICE

CERTIFICATE OF CORRECTION

PATENT NO. : 6,527,604 B2
DATED : March 4, 2003
INVENTOR(S) : Masanori Tsubouchi et al.

It is certified that error appears in the above-identified patent and that said Letters Patent is hereby corrected as shown below:

Column 12,
Line 18, change “mountcase” to -- mount case --.

Column 13,
Line numbered between 36 and 37, change “siding” to -- sliding --.

Column 14,
Line 9, change “71, 71*b*” to -- 71*a*, 71*b* --.
Line 10, change “which ever” to -- whether --.

Column 16,
Lines 52 and 62, change “right left” to -- right and left --.

Column 17,
Line 3, change “maneuver ability” to -- maneuverability --.

Column 18,
Line 2, “change “crank shaft” to -- crankshaft --.
Line 6, change “pimp” to -- pump --.

Column 19,
Line 3, change “crank case” to -- crankcase --.

Signed and Sealed this

Twenty-fourth Day of June, 2003

JAMES E. ROGAN
*Director of the United States Patent and Trademark Office*